US007620189B2

(12) United States Patent
Lang et al.

(10) Patent No.: US 7,620,189 B2
(45) Date of Patent: Nov. 17, 2009

(54) POLARIZATION VOLTAGE SETTING OF MICROPHONES

(75) Inventors: Werner Lang, Vienna (AT); Kurt Nell, Breitenfurt (AT)

(73) Assignee: AKG Acoustics GmbH, Vienna (AU)

( * ) Notice: Subject to any disclaimer, the term of this patent is extended or adjusted under 35 U.S.C. 154(b) by 997 days.

(21) Appl. No.: 11/094,805

(22) Filed: Mar. 30, 2005

(65) Prior Publication Data

US 2005/0220314 A1 Oct. 6, 2005

(30) Foreign Application Priority Data

Mar. 30, 2004 (EP) ..... 04450073
Mar. 30, 2004 (EP) ..... 04450075
Mar. 30, 2004 (EP) ..... 04450075
Mar. 30, 2005 (EP) ..... 04450074

(51) Int. Cl.
*H04R 3/00* (2006.01)

(52) U.S. Cl. ..... 381/113; 381/111; 381/122; 330/297

(58) Field of Classification Search ..... 381/91, 381/95, 111–115, 122, 174; 330/297, 135, 330/136
See application file for complete search history.

(56) References Cited

U.S. PATENT DOCUMENTS 2,493,819 A 1/1950 Harry
3,707,091 A 12/1972 Morris et al.
4,414,433 A * 11/1983 Horie et al. ..... 381/92
4,541,112 A 9/1985 Kern
4,543,665 A 9/1985 Sotelo et al.
4,622,692 A 11/1986 Cole
4,893,240 A 1/1990 Karkouti
5,459,283 A 10/1995 Birdwell, Jr.
5,577,129 A * 11/1996 Ehara ..... 381/113
5,579,397 A * 11/1996 Ikeda et al. ..... 381/113
5,610,988 A 3/1997 Miyahara
6,007,228 A 12/1999 Agarwal et al.
6,028,946 A 2/2000 Jahne
6,427,015 B1 * 7/2002 Backram et al. ..... 381/120
6,577,187 B1 * 6/2003 Lesko ..... 330/11
6,792,121 B2 9/2004 Koyama et al.
7,024,155 B2 4/2006 Gosieski, Jr.
7,158,646 B2 * 1/2007 Bank et al. ..... 381/113
7,167,054 B1 * 1/2007 Dening et al. ..... 330/297
7,170,394 B2 1/2007 Chandler et al.
7,208,919 B2 * 4/2007 May ..... 323/211

(Continued)

FOREIGN PATENT DOCUMENTS

DE 20 20 739 A 11/1971

(Continued)

OTHER PUBLICATIONS

European Search Report for Application No. 04 45 0075.9 dated Jan. 20, 2005.

(Continued)

*Primary Examiner*—Xu Mei

(57) ABSTRACT

A microphone includes a microphone capsule biased with a polarization voltage from a winding on a transformer. The polarization voltage is controlled by a regulation circuit that may have an analog regulation circuit and a digital regulation circuit. A controller adjusts the polarization voltage that varies the sensitivity of the microphone.

27 Claims, 10 Drawing Sheets

U.S. PATENT DOCUMENTS

| | | | | |
|---|---|---|---|---|
| 7,356,151 | B2 * | 4/2008 | Seknicka | 381/113 |
| 7,391,873 | B2 * | 6/2008 | Deruginsky et al. | 381/113 |
| 7,489,791 | B2 * | 2/2009 | Kunnen et al. | 381/113 |
| 2006/0147062 | A1 * | 7/2006 | Niwa et al. | 381/113 |
| 2007/0269058 | A1 * | 11/2007 | Akino | 381/113 |

FOREIGN PATENT DOCUMENTS

| | | | |
|---|---|---|---|
| DE | 21 26 385 | A | 12/1971 |
| DE | 39 33 870 | A | 4/1991 |
| DE | 3933870 | A1 | 4/1991 |
| EP | 0 096 778 | A2 | 12/1983 |
| EP | 096 778 | A | 12/1983 |
| EP | 0 794 686 | A2 | 9/1997 |

OTHER PUBLICATIONS

European Search Report for Application No. 04 45 0074.2 dated Feb. 23, 2005.

* cited by examiner

POLARIZATION VOLTAGE SETTING OF MICROPHONES

PRIORITY CLAIM

This application claims the benefit of priority from European Patent Application Nos. 044 500 75.9, 044 500 74.2 and 044 500 73.4, filed on Mar. 30, 2004, each of which is incorporated herein by reference in its entirety. The application is also related to U.S. patent applications filed on Mar. 30, 2005, each entitled Microphone System, having Ser. Nos. 11/094,825and 11/093,762 respectively, each of which is incorporated herein by reference in its entirety.

BACKGROUND OF THE INVENTION

1. Technical Field

This invention relates to circuits that regulate voltages, and in particular, circuits that regulate polarization voltages for capacitor microphones.

2. Related Art

Power may be supplied to a microphone through a mixer from a phantom power supply. The feed voltage may be applied through two identical feeder resistances from two cable conductors of an audio cable. The power supply current may be limited to maximize the voltage available to the microphone. A 48-V capacitor microphone may consume 10 mA.

The polarization voltage on a microphone diaphragm may be from 20 to 100 volts DC, and may be supplied by a voltage converter. The polarization voltage is directly related to the sensitivity of the microphone capsule. Power may be supplied by a linear regulator to a processor, A/D converter, or LED within the microphone. As circuits are added, the voltage may become difficult to regulate especially with an increasing current flow. As the current increases, the elements consume more power and the voltage drop increases across each element, especially the voltage across the feeder resistances. As the voltage drops across the feeder resistances increase, the polarization voltage and supply voltage for the audio amplifier decreases. The reduced polarization voltage decreases the sensitivity of the microphone capsule.

SUMMARY

A capacitor microphone includes a polarization voltage that may be controlled to adjust the sensitivity of a microphone capsule. The microphone capsule may have a diaphragm. The microphone may include a power controller and a transformer. The microphone may have an analog voltage regulator circuit that may be controlled with a digital voltage regulator circuit. The digital voltage regulator circuit may have a controller that sets the value of the polarization voltage.

The power controller may convert a DC voltage to an AC voltage. The AC voltage may be applied to a transformer having a multiple number of secondary coils. The secondary coils may supply individual circuits that provide control, audio amplification, polarization voltage, and LED status display. The polarization voltage circuit may include an analog regulator circuit that is controlled with a digital regulator circuit. The digital regulator circuit may include a controller capable of adjusting the polarization voltage to a desired value.

A method may provide for controlling a polarization voltage. The method may include supplying DC power to a microphone, converting the DC power to AC power, transforming the AC voltage to another AC voltage and rectifying the other voltage to a DC voltage. The method may include regulating the polarization voltage with an analog regulating circuit. The method also may include controlling the polarization voltage with a digital regulation circuit.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A microphone system includes a microphone capsule, an audio amplifier and an electronic circuit. The microphone electronics may include processors, control electronics, A/D and D/A converters, and/or LED displays. The microphone may include a phantom power supply that provides power through two or more cable conductors of an audio cable. The microphone may include a power supply. The power supply may include a power controller connected to a transformer. The power controller may convert direct current transmitted via the cable conductors of the audio cable into alternating current. The power supply may include a supply loop. Each circuit receiving power from the transformer may be connected to an individual secondary coil of the transformer.

The power supply may further include a constant current generator. The constant current generator, with respect to the phantom power supply, may be a constant current sink. The constant current generator may be a constant current generator for the power supply. The high impedance of the constant current generator may filter a switching ripple that may be generated during a DC/AC conversion. The high impedance may attenuate or minimize a switching interference that may disrupt or distort an audio signal.

Figure 1:
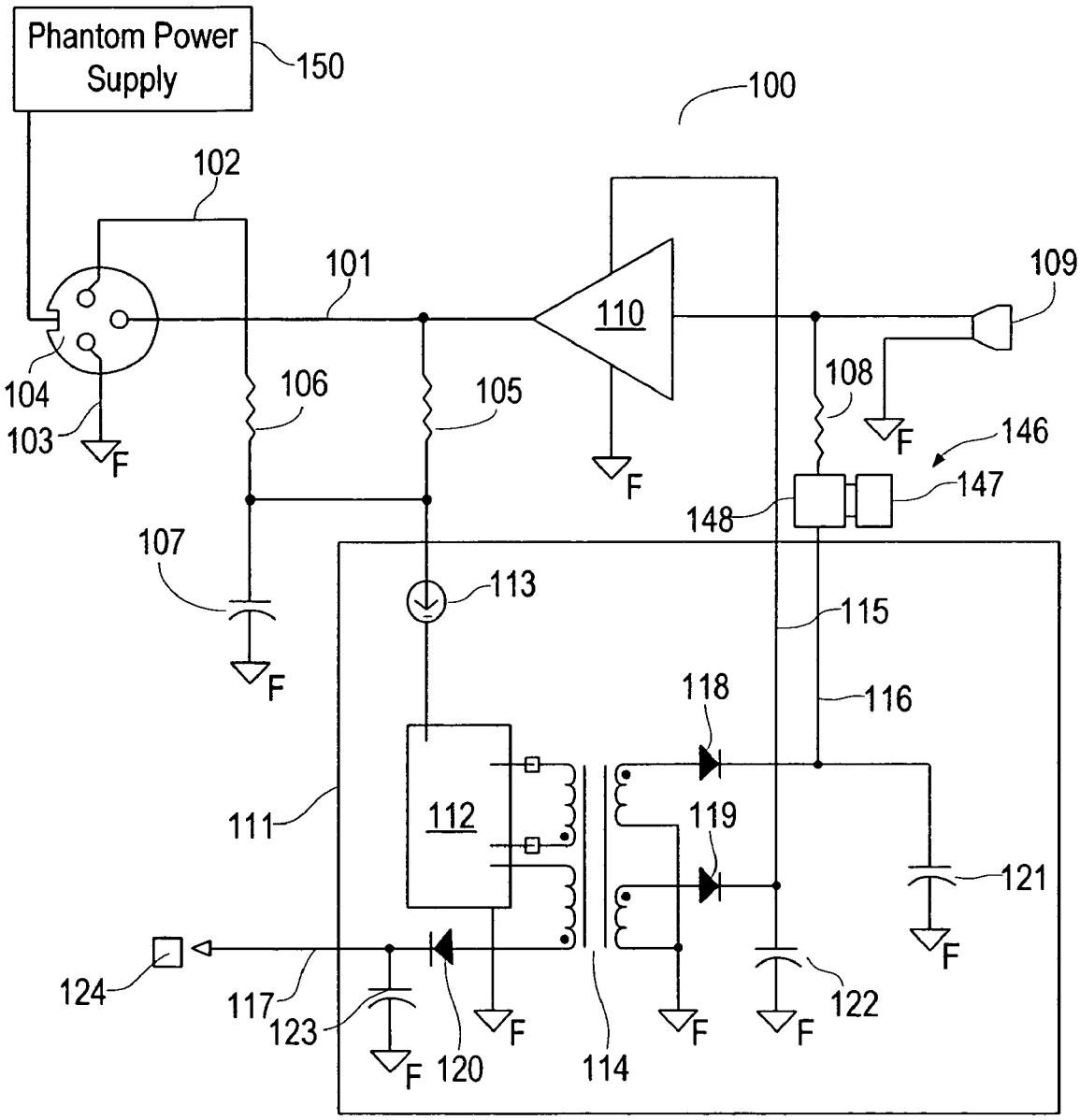
FIG. 1 is block diagram of a capacitor microphone.

FIG. 1 is a block diagram of a microphone system 100. The microphone system 100 may include a capacitor microphone. The capacitor microphone may have a membrane or diaphragm and a back plate or double membranes that form opposing plates of a capacitor. Sound pressure or vibrations may move the membranes. The movement changes the capacitance and generates a changing electric output. A power supply provides a polarization voltage for the capacitor. The power supply may be integrated within a mixer.

Other types of microphones may be used, such as dynamic microphones. A dynamic microphone may include a magnet with coils. A diaphragm is placed adjacent to the coils and moved by a changing sound pressure. The moving coils cause current to flow in the direction of magnetic flux from the magnet. No battery or external power supply may be applied to a dynamic microphone. However, the dynamic microphone may include a phantom power supply to provide power for other electronic circuits in the microphone.

The dynamic and capacitor microphones are analog microphones. A digital microphone may digitize audio signals with an analog-digital converter. Resulting two-channel digital audio signals are transmitted via a symmetrical two-wire conductor to an associated amplifier. A power supply may provide the digital microphone with power via the same two-wire conductor. Pulses may be modulated onto the voltage of the power supply of the microphone. In the analog microphones, an analog signal may be transmitted via the phantom power lines or cable conductors. In the digital microphone, the modulated signals may be simultaneously transmitted with the digital audio signals. The digital audio signal may be easily separated from the modulated signal.

The microphone system 100 may include an audio amplifier 110, a power supply 111 and a phantom power supply 150. The phantom power supply 150 may include a phantom supply unit and feeder resistors of substantially identical magnitude, which are arranged with a 3-pin plug 104 such as an XLR plug shown in a phantom power supply 531 of FIG. 5.

The phantom power supply 150 of FIG. 1 may provide output voltages that range from about 9 volts to about 48 volts. The current consumption of the microphone system 100 may be minimized to restrict voltage drops. Large currents may cause excessive voltage drops across feeder resistors 105 and 106. For example, the maximum current from a phantom power supply 150 with about a 48 Volt output may be about 10 mA. Voltage and current values from phantom power supplies have been standardized according to the DIN EN 61938 Standard (formerly IEC 268). The DIN EN standard is the European standard defined by Deutsches Institut for Normung e. V. and was formerly referred to as the IEC (International Electrotechnical Commission) standard.

Phantom power supplies 150 may provide about 12 Volts, 24 Volts, or 48 Volts. These values are coupled to the value of the feeder resistances 105 and 106. A phantom power supply 50 providing about 12 Volts may have a feeder resistor 105 and 106 value of about 680 Ω, 24 Volts may be matched to about 1.2 kΩ and 48 Volts with about 6.8 MΩ, respectively. The phantom power supply 150 provides power through cable conductors 101 and 102. Cable conductor 103 may be grounded (e.g. "F" identifies a ground connection) through a cable shielding. The phantom power supply 150 may be connected to the power supply 111 through the cable conductors 101 and 102 of an audio cable and resistors 105 and 106. A capacitor 107 may filter a supply voltage relative to ground. The feeder resistors 105 and 106 may be used for decoupling the power supply 111 from the output of an audio amplifier 110.

The feeder resistors 105 and 106 may be additional internal resistances to the phantom power supply 150. When the internal resistance of the phantom power supply 150 matches the internal resistance of the power supply 111, a power adaptation may be performed if the supplied voltage changes. In a power adaptation, half of the voltage of the phantom power supply 150 may be used as a supply voltage for the power supply 111. The supply voltage may be the maximum voltage that the phantom power supply 150 produces. The supply voltage may be distributed by the power supply 111 to other circuit components in the microphone 100. The power supply 111 may be a DC/DC converter. The DC/DC converter may change DC electrical power from one level to another. By way of example, a DC voltage from a battery may be stepped down or up for circuits requiring a different voltage value. After power is distributed to the electronic circuits, excess power may be sourced to the audio amplifier 110. With regard to the different supply voltages such as the 12 Volt, 24 Volt, or 48 Volt supply, the power supply 111 may adapt to a different phantom power supply automatically. The power controller 112 in the power supply 111 may perform the adaptation.

The power supply 111 may include the power controller 112, a constant current source 113 and a transformer 114 connected to the power controller 112. The power controller 112 and the transformer 114 may convert a DC voltage to an AC voltage. The transformer 114 may form an oscillator with the power controller 112. Alternatively, an alternating current may be generated by the power controller 112, independent of the transformer 114. The transformer 114 may convert the alternating current into individual output voltages.

The AC signal may have a frequency in the range of about 100 kHz to about 130 kHz. The AC signal may oscillate freely within a predetermined range of about 100 kHz to about 130 kHz. Preferably, the frequency range of the AC signal is above of the frequency of the audio signals. If the frequency of the AC signal overlaps the frequency of the audio signals, some audio content may be lost or become garbled with the resulting interference. The interference may not be eliminated with simple filtering techniques.

Figure 5:
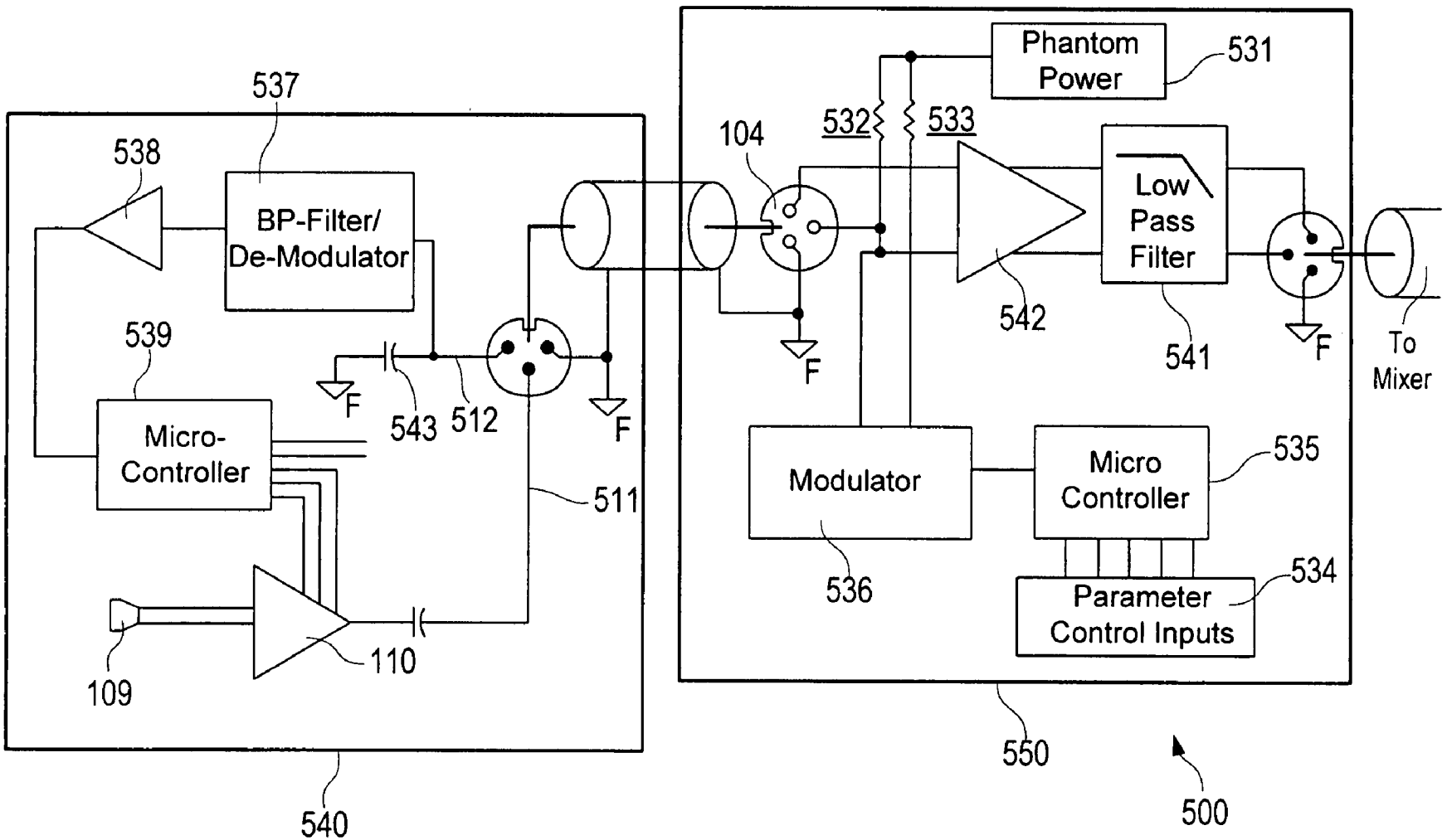
FIG. 5 is a block diagram of a capacitor microphone connected to a remote control unit.

An AC signal with a frequency of about 100 kHz~130 kHz may be used as a clock pulse for microphone electronics, such as microphone control electronics 539 in FIG. 5. Interfering signals may be minimized because the AC signal and the control electronics operate on a common frequency.

Where the power controller 112 generates the AC signal, the AC signal may be fed to the transformer 114. Secondary coils on the transformer 114 may create separate current loops 115, 116 and 117 supplying power to other circuit components in the microphone system 100. The supply loop 116 may provide a polarization voltage to a microphone capsule 109 through a resistor 108. Another current loop 117 may be coupled to a logic supply 124.

Each loop 115, 116, and 117 may be supplied with a different voltage from an individual secondary coil without degrading the supplied power to other circuits such as the audio amplifier 110. The diaphragm of the microphone capsule 109 may continue to receive a high voltage relative to the other circuits even if the current through the power supply 111 increases. The higher voltage may be provided by increasing the number of windings in a secondary coil that supplies the polarization voltage to the microphone capsule 109.

Diodes 118, 119 and 120 and capacitors 121, 122 and 123 are provided in the supply loops 115, 116 and 117. The diodes 118, 119 and 120 may be rectifier elements that convert AC voltages to DC voltages. Other rectifier circuits may be substituted. The uncoupling of the voltage loops 115, 116 and 117 may minimize power loss and provide different voltages supplied simultaneously to the components that require various voltages and current. For example, a high voltage and small current may be supplied as a polarization voltage, a moderate voltage and a moderate current may be supplied to an audio amplifier 110, and a small voltage and large current may be supplied to the microphone electronics.

With this power supply 111, the microphone system 100 may provide added functions such as remote control or automatic compensation. Even with the added functional capabilities, the audio output power may be maintained. The polarization voltage may be maintained at a constant voltage when a secondary coil supplies the voltage to just the microphone coil 109.

The phantom power supply 150 may be used for other types of microphones including dynamic microphones. The dynamic microphones may not need a polarization voltage and the associated supply loop 116 may be eliminated. In this configuration, the phantom power supply 150 may supply power to the microphone electronics.

The constant current generator 113 may supply a constant primary current. The constant current generator 113 may function as a constant current sink for the phantom power supply 150 and as a constant current generator for the power supply 111. The constant current generator 113 may have a high impedance level that filters the noise produced during DC/AC conversion and prevent an interference from disrupting the audio signal.

Figure 2:
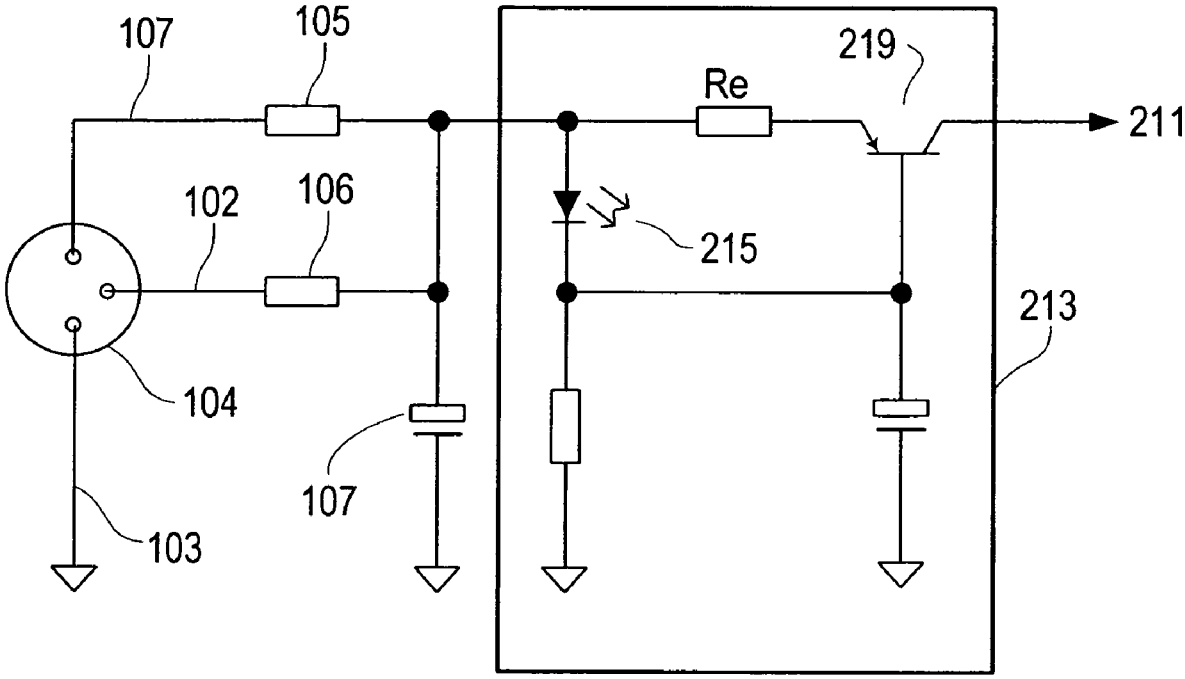
FIG. 2 is a circuit diagram of a transistor and LED constant-current circuit.

FIG. 2 is a block diagram of a constant current generator 213. The constant current generator 213 may be a transistor-light emitting diode ("LED") combination. The transistor may be a bipolar transistor 219. The constant current may forward-bias the LED 215 developing a constant voltage across the junction of the LED 215. The constant voltage is applied across the parallel combination of the emitter-base junction of the bipolar transistor 219 and the emitter resistance Re. The constant current developed by this arrangement may be determined by the following:

$$I_{213}=(U_{LED}-U_{be})/Re \quad (1)$$

where $U_{LED}$ is the voltage across the LED 215, $U_{be}$ is the base emitter voltage at the transistor 219, and Re is the emitter resistor.

Figure 3:
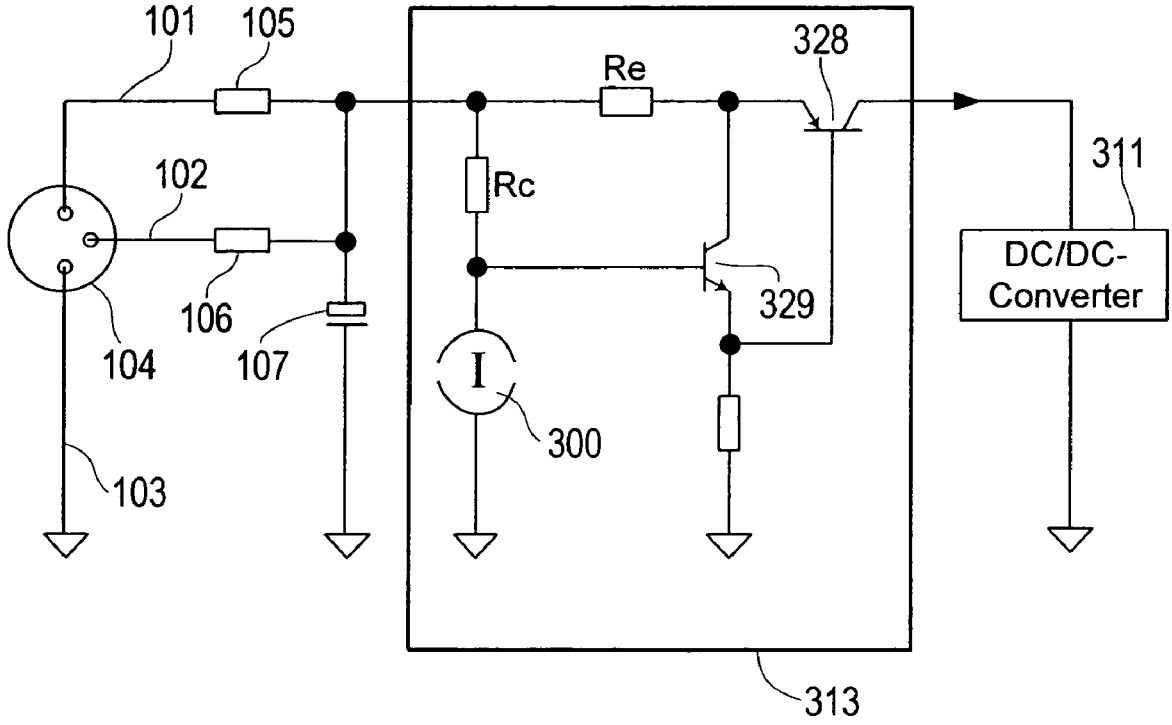
FIG. 3 is a circuit diagram of a cross-coupled transistor constant-current source.

FIG. 3 is a block diagram of another constant current generator 313. The constant current generator 313 may include two counter-coupled degenerated transistors 328 and 329. The constant current generator 313 also may include an integrated constant current generator 300. The current generator 300 develops a voltage drop, $U_{Rc}$ across a resistor Rc. The voltage $U_{Rc}$ approximately equals a voltage drop $U_{Re}$, at an emitter resistor Re of the transistor 328. The constant current developed by the constant current generator 300 is determined by:

$$I_{300}=U_{Rc}/Re \quad (2)$$

The transistor 329 and the transistor 328 may form a counter-coupled degenerated system that provides substantially equal voltage drops at the resistors Rc and Re. As a result, the current $I_{300}$ of the current generator 300 may remain constant. The current from the current generator 313 may be a factor of about 100 less than a constant current that finally flows into a DC/DC converter 311.

The constant current generators 213 and 313 may provide a constant current and a higher start resistance. However, a constant current generator used with the microphone system 100 is not limited to the constant current generators 213 and 313 previously described. Other types of constant current generators may include current generators with an inverted operation amplifier, such as Howland current generators.

In FIG. 1, the supply loop 116 for the microphone capsule 109 may include a regulation circuit 146 between the diode 118 and the resistor 108. The regulation circuit 146 may include a digital regulation circuit 147 and an analog regulation circuit 148, that control the polarization voltage applied to the microphone capsule 109. Control signals may be transmitted through one of the two cable conductors 101 and 102. In the supply loops 115 and 117, regulator circuits may be provided if voltage regulators are not provided in digital circuits. For instance, the microphone system 100 does not include a regulator circuit in the supply loop 115 for the audio amplifier 110. Thus, it may be possible to use excess power that is not used in other circuits in the microphone for the audio amplifier 110. Other circuits may include processors, control electronics, polarization voltage circuits for the microphone capsule 109, A/D or D/A converters, LED displays, etc. A higher audio output voltage may be achieved.

The supply voltage for the audio amplifier 110 may be greater than a voltage supplied from the phantom power supply 150. For example, by arranging the number of windings and the direction of the windings, it is possible to produce positive and/or negative supply voltages for the audio amplifier 110. If both a positive and a negative voltage are produced, the audio amplifier 110 may use the ground potential as a rest potential. The positive and negative supply voltage for the audio amplifier 110 may be symmetrical with respect to ground.

Figure 4:
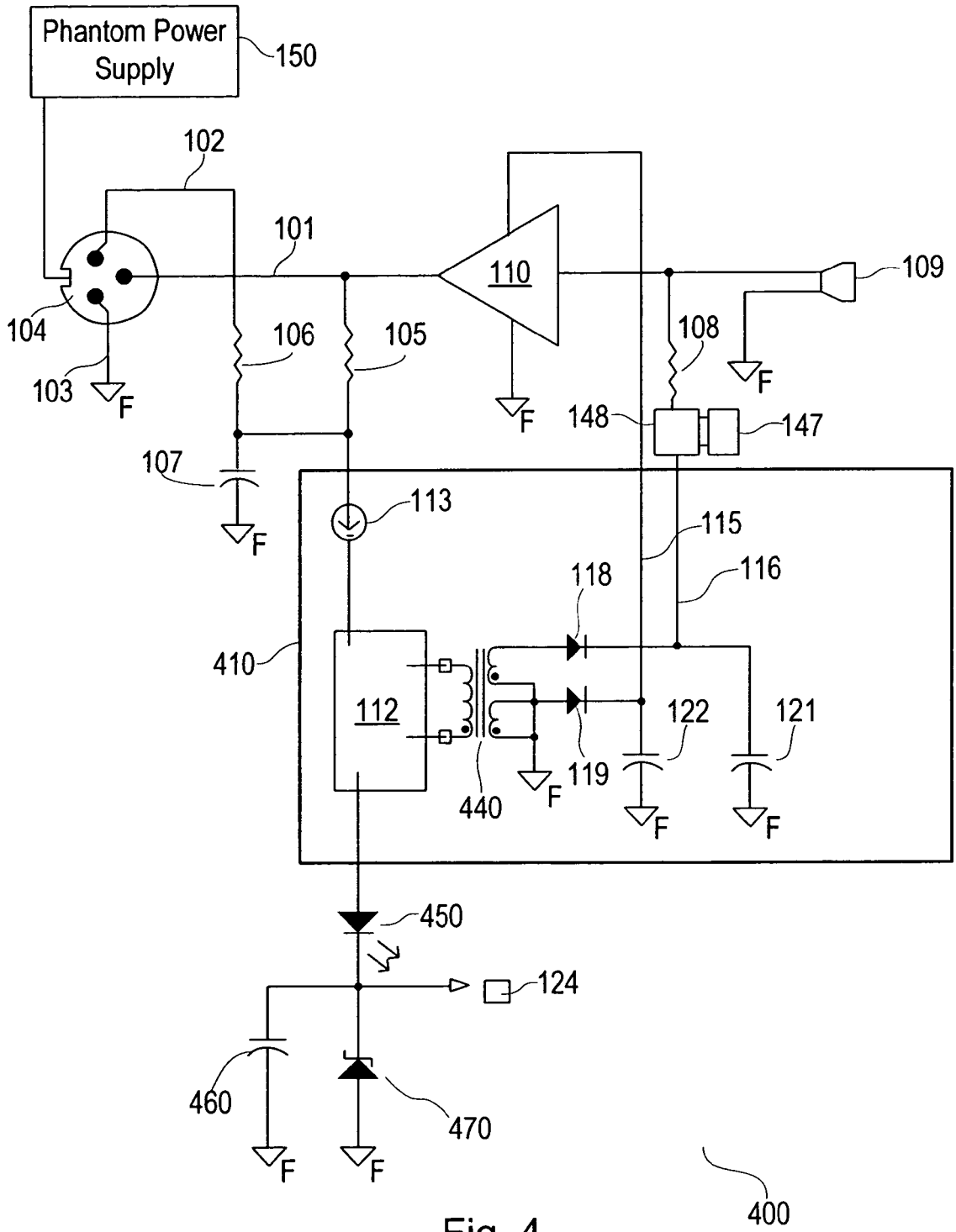
FIG. 4 is a block diagram of a capacitor microphone with a digital logic supply circuit.

FIG. 4 is a block diagram illustrating another example of a microphone system 400. The microphone system 400 may include a power supply 410 that generates a polarization voltage for the microphone capsule 109 and a voltage for the audio amplifier 110. Other circuits may receive power from the logic supply 124. The logic supply 124 may make a predetermined fixed direct current available to the circuits such as the control electronics and an LED display 450. The logic supply 124 may be connected in series to the power supply 410. The power supply 410 may act as an active load. Power consumed at the active load may not be converted into heat, but into usable power for the audio amplifier 110 and the polarization voltage for the microphone capsule 109.

The microphone system 400 may include a Zener diode 470 providing a reference voltage to the logic supply 124 or additional digital electronics. The Zener diode 470 may stabilize the supply voltage. The current consumed by the logic supply 124 may vary. The Zener diode 470 may pass the excess current from the constant current source 113 to the ground. In place of the Zener diode 470, other devices such as a constant-current generator or a shunt regulator may be used.

In the microphone system 100 of FIG. 1, power may be the product of the current of the constant current generator 113 and the voltage applied to the power supply 111. In FIG. 1, the entire voltage may be applied to the power supply 111. In FIG. 4, the supply voltage is applied to the power supply 410, the LED 450 and the logic supply 124. The logic supply 124 voltage may be determined by the Zener diode 427. The power supply 410 may represent an active resistance. The current consumption of the logic supply 124 may not be constant and may vary depending upon operation. However, the current by the current generator 113 remains constant. The excess current may develop depending on operation of digital electronics. The excess current may pass through the Zener diode 470. The power available for the audio amplifier 110 may be computed as follows:

$$P_{AA}=(I_{DC/DC})\times(V_{DC/DC})\times\eta \quad (3)$$

where $I_{DC/DC}$ is the current through the power supply 410, $V_{DC/DC}$ is the voltage across the power supply 410, and η is the degree of efficiency of the power supply 410. The power supply 410 may lose some of power because power is dissipated by the transformers, resistors, capacitors and diodes during operation. Power loss may occur at the power supply 410 during DC/DC conversion. The power loss may be indicated as the efficiency η of the power supply 410. For instance, the degree of efficiency η may be approximately 82%. The power at the LED may be computed by:

$$P_{LED}=(I_{LED})\times(V_{LED}) \quad (4)$$

The LED displays, control electronics, etc. may avoid power loss by a series connection to the power supply 410 as shown in FIG. 4. These microphone electronics may be connected to the logic supply 124 and receive a constant direct current from the current generator 113.

By way of example, the current consumption of the audio amplifier 10 may be about 0.8 mA in an uncontrolled state and the current consumption of the digital electronics may be about 4.2 mA. The current generator 113 may deliver about 4.7 mA. The Zener diode will conduct about 0.5 mA to ground, which is the excess current. To improve the efficiency of the power supply 410, it may be advantageous to provide the voltage for the digital electronics through a series connection with the power supply 410. In other applications, it may be more advantageous to provide the voltages through the power supply 111, as shown in FIG. 1.

The supply voltage to the audio amplifier 110 may provide a higher available power from the amplifier 110. The power may be as follows:

$$P=4.7\text{ mA}\times18\text{ V}\times0.82=69\text{ mW} \quad (5)$$

The voltage is found from the following:

$$V=P/I=69\text{ mW}/0.8\text{ mA}=55\text{ V} \quad (6)$$

This voltage is higher than about 24 Volts supplied by the phantom power supply 150. Due to the polarization voltage generated on the membrane of the microphone capsule 9, the supply voltage to the audio amplifier 110 may be lower than about 55V. However, it is still much higher than 24 V provided by the phantom power supply 150.

FIG. 5 is a block diagram of a remote control system 500 for a microphone system 540 to regulate or change operational parameters. The parameters may include the sensitivity of a microphone, its directional characteristics, the voltage from the phantom power supply, a serial number, calibration data from manufacturers, signal attenuation, connectable filters for the audio signal, etc.

When a limited amount of parameters are available, the control signal may be represented by the value of the supply voltage. A supply voltage value may be applied to a cable conductor where the supply voltage is controlled via a remote power controller. In a mixer or mixing table, the value of the supply voltage may represent the control signal for the microphone. The value of the supply voltage is sensed at the microphone and routed to an evaluation circuit. The evaluation circuit may generate a control signal as a function of the value of the supply voltage. Few parameters may be transmitted to the microphone using this method of control.

A polarization voltage may be used to control the microphone sensitivity and reception parameters. When the polarization voltage is applied to the membrane of a capacitor microphone, the level of the polarization voltage may be directly related to the sensitivity of the microphone capsule. With a double membrane capacitor capsule, it may be possible to regulate the sensitivity and the directional characteristics when each membrane is separately supplied with the polarization voltage. The polarization voltage may be controlled with fixed value resistors or trim resistors. During initial assembly of the microphone, a one-time adjustment of the polarization voltage may occur. This adjustment may not be accurate if the sensitivity changes during the use or damage to the microphone capsules. Aging may play a role as well, as the membrane oxidizes or becomes fatigued from extended use. Thus, the polarization voltage may be compensated during sound checks at any time to offset the effects.

FIG. 5 illustrates a circuit where the control signal is a frequency modulated signal that superimposes the supply voltage over one of the two cable conductors. The frequency modulated signal at the microphone may be applied to the microphone control electronics. The microphone control electronics may demodulate the signal and send the commands to the appropriate device.

The frequency modulated signal may be a frequency shift keying (FSK) signal or continuous phase FSK (CPFSK) signal. Other modulation techniques such as amplitude shift keying (ASK) or phase shift keying (PSK) may be used, although the ASK modulation may be subject to interference, and the PSK modulation may be difficult to implement.

The microphone system may provide improved operational capabilities. The polarization voltage may be adjusted controlling the sensitivity and directional characteristic of the microphone. Other signals may send calibration data to a microprocessor for storage. Modifications to the frequency range audio output power, amplification, and total harmonic distortion (THD) of the audio amplifier 110 may be changed. Such controls may use high data rates.

The frequency modulated voltage may be superimposed on the supply voltage from the phantom power supply. A transmitter in the mixing table or in a device on the mixing table may send the control signals to the microphone via audio lines. The carrier frequency for FSK modulation may be higher than the audio frequency transmitted from the microphone. The frequency modulated signal allows for a higher data rate than the transmission of DC voltage levels. The carrier frequencies may be about 100 kHz and may be separated from the audio signal by using filters.

In the remote control system 500, the microphone system 540 may connect to a transmitter or a remote control unit 550. Microphone parameters may be remotely controlled directly through audio cable conductors 511 and 512. The remote control unit 550 may be a part of the mixer (not shown) or connected to the front end of the mixer. The remote control unit 550 may include a microcontroller 535 with a parameter control input 534 that controls a frequency modulator 536. The frequency modulator 536 may apply the frequency modulated signal at substantially the same level to the two cable conductors 511 and 512. The frequency-modulated signal may be suppressed as a common mode signal in a differential input amplifier 542. A supply voltage from a phantom power supply 531 may be applied through feeder resistors 532 and 533 to the cable conductors 511 and 512. The frequency modulated signal may be applied on one conductor 512 of the audio cable. As such, the conductor 512 may not be used for the audio signal.

The microphone 540 may include a filter 537, a comparator 538, control electronics 539 and a capacitor 543. The filter 537 may separate the frequency modulated voltage from the audio signal. A band pass filter may be used as the filter 537. Even when the frequency modulated signal is fed into the conductor 512, the capacitive coupling between the two conductors 511 and 512 may cause interference with the audio signal. The capacitive coupling depends on the structure and the length of the audio cable.

The control electronics 539 may evaluate the control information that is received. The control electronics 539 may be a microcontroller or a CPLD (Complex Programmable Logic Device). The cable conductor 512 is uncoupled through a capacitor 543 to ground. The control electronics 539 are connected to a comparator 538 functioning as a voltage comparator. Commands from the control electronics 539 may be sent to the power supply 111, the audio amplifier 110, processors, A/D or D/A converters 440 of FIGS. 1 and 4.

The audio signals from the microphone system 540 may be transmitted to the mixer or mixing table. To suppress the modulation frequency from the remote controller, the modulation may be applied to both audio lines 1 and 2 at about the same level. The frequency modulated signal may be a common mode signal to the differential input amplifier 542 and appropriately suppressed as a common mode signal. Alternatively, the frequency modulation may be applied to one line 512 and that line does not transmit the audio signal. The frequency modulated signals may be filtered by a low pass filter 541 at the mixer or mixing table.

After receiving a control signal, the control electronics 539 may acknowledge the receipt to improve the reliability of the system. The acknowledge message may be a frequency modulated signal. However, an acknowledgement may be omitted.

The phantom power supply 531, including the feeder resistors 532 and 533, the differential input amplifier 542 and the low pass filter 541, may be integrated within the remote control unit 550 as shown in FIG. 5. Alternatively, or additionally, the phantom power supply 531 and other components may be integrated within the mixer. The microphone system 540 of FIG. 5 is not limited to capacitor microphones. Other types of microphones may be used such as dynamic microphones. The components in the microphones may receive power from the phantom power supply 531.

Figure 6:
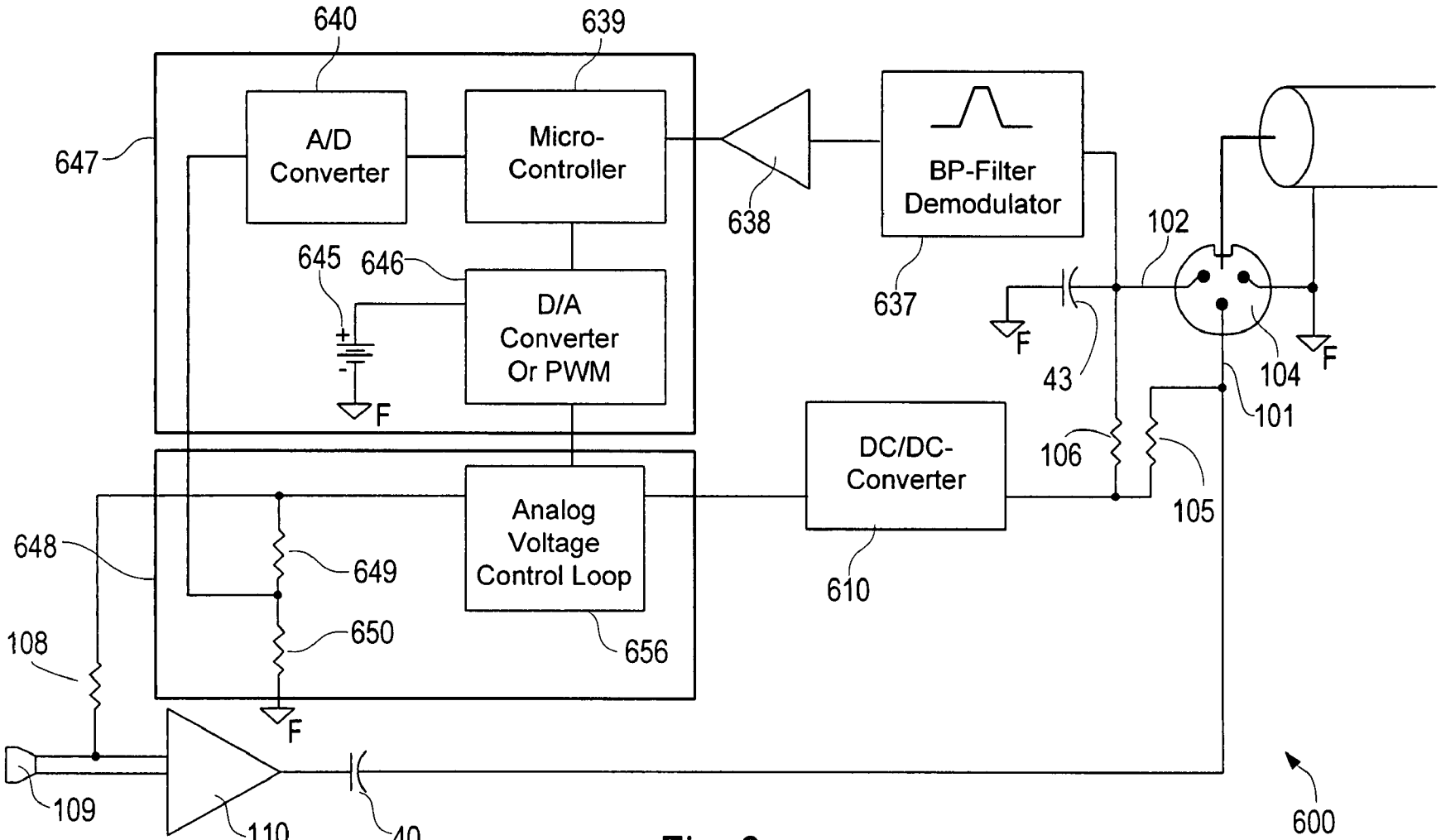
FIG. 6 is a block diagram of a circuit that adjusts a polarization voltage.

FIG. 6 is a block diagram of another example of a capacitor microphone 600. The capacitor microphone 600 may include a circuit for regulating a polarization voltage such as the regulation circuit 147 and 148 of FIG. 1. The circuit may include an analog regulator circuit 648 that is supplied with an unregulated voltage and is connected to a digital regulator circuit 647. The digital regulator circuit 647 may include control electronics 639 that provide a desired value for a polarization voltage. The value of the polarization voltage may be calculated from correction factors that may have been determined during sound checks. For providing feedback, the output of the analog regulation loop 648 may be connected to the control electronics 639. The capacitor microphone may satisfy low tolerances with respect to the polarization voltage, for example, a tolerance of about ±0.5 dB. The flexible adjustment of the polarization voltage may be possible during the assembled state of the microphone system 600.

The polarization voltage may be adjusted by the digital regulator circuit 647. The value of the polarization voltage may be established through a D/A converter 646 and the control electronics 639. The desired value of the polarization voltage also may be transmitted to the control electronics 639 by a remote control. The tolerance of the acquired polarization voltage may depend on the tolerance and the thermal behavior of a reference voltage source. The reference voltage source may be the voltage provided to the logic source 124.

In conjunction with FIG. 5, the frequency modulated signal, transmitted through the cable conductors 511 and 512, may be connected to the phantom power supply 531. The frequency modulated signal may be received by the control electronics 639 via a band-pass filter/demodulator 637 and a comparator 638. Alternatively, the control electronics 639 may be connected to a radio or an infrared interface for wireless transmission. Instead of the D/A converter 646, a pulse width modulation (PWM) circuit may be used. Although a PWM circuit has lower conversion rates, it may be cost efficient and suitable for adjusting constant levels.

The regulation of the polarization voltage via the digital regulator circuit 647 may provide a precise, interference resistant, and remote controllable adjustment of the polarization voltage. During manufacture, narrow tolerance requirements may be achieved with respect to the sensitivity and directional characteristic. Readjustments by fixed resistances or trim resistances may not be needed.

Remote control of the polarization voltage provides varying directional patterns/characteristics, and adjustable microphone sensitivities for double membrane microphone capsules. Correction factors may be calculated and stored to compensate the polarization voltage. The polarization voltage may be calibrated during acoustical measurements with a closed microphone and correction factors may be stored. The adjustable polarization voltage using the remotely controlled microphone may provide directional effects during operation. For example, the microphone may acoustically follow the movement of actors who are performing on a stage.

Remote control of the microphone may compensate for the aging effects of the membrane and allow for the recalibration of the microphone sensitivity. After replacement of the microphone capsule, the sensitivity of the microphone may be readjusted by remote control.

Figure 7:
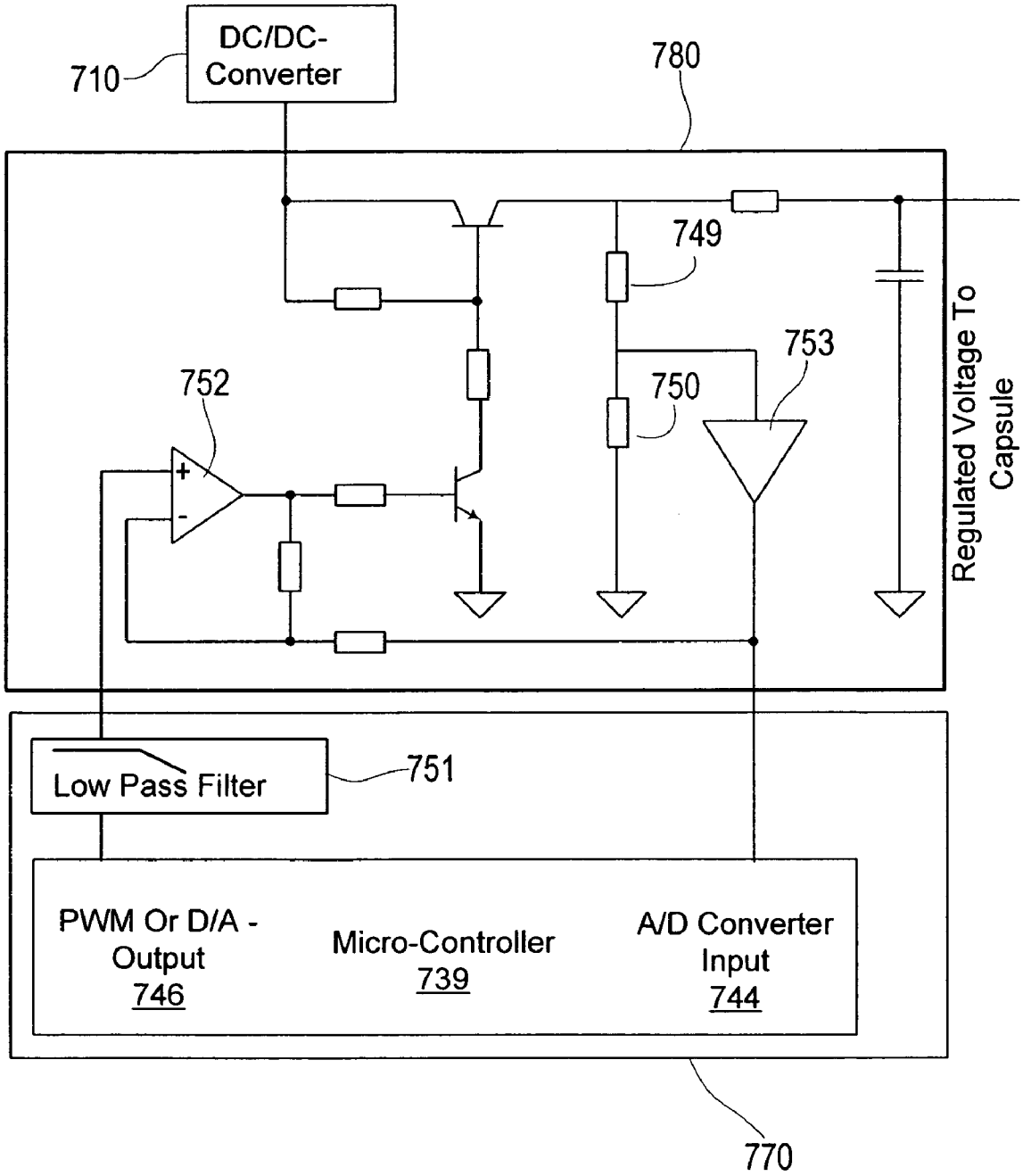
FIG. 7 is a control circuit for adjusting the polarization voltage.

FIG. 7 is a block diagram of a digital regulation loop 770 and an analog regulation loop 780. The digital regulation loop 770 may include a microcontroller 739, an A/D converter 744, a D/A converter 746 and a low pass filter 751. A PWM may be used in place of the D/A converter 746. The analog regulation loop 780 may include voltage dividers 749 and 750, an operation amplifier 752 and an impedance converter 753. A DC/DC converter 710 may provide an unregulated voltage of about 100~120 Volts to the analog regulation loop 780.

The desired value may be compared with an actual value by the operation amplifier 752. The desired value may be calculated from the calibration data measured during manufacture of a microphone and programmed into the microcontroller 739. As a reference value for this calculation, either a reference voltage such as a reference voltage 645 of FIG. 6 on the conductor or a reference voltage programmed into the microcontroller 739 may be used. The reference voltage may be from a logic supply such as the logic supply 124 of FIG. 4.

To suppress high frequency interference from the analog regulation circuit 780, the low pass filter 751 may be connected between the D/A converter 746 and the input of the analog regulation loop 780 as illustrated in FIG. 7. The analog regulation loop 780 may develop the feedback signal with the voltage dividers 749 and 750, applying the signal through the impedance converter 753 to the inverted input of the operation amplifier 752. The feedback line and the impedance converter 753 may not be included. The feedback signal may be applied to an input of an A/C converter 744 in the digital regulation loop 770. The digital signal is fed to the microcontroller 739. The outer digital regulator circuit 770 is a closed feedback loop. The A/D converter 744, the microcontroller 739, and the D/A converter 746 may be integrated within one package.

The regulated polarization voltage may be applied to the microphone capsule 109 via a high resistance. Correction factors may be available to calculate a regulated and interference free polarization voltage depending on different settings, reflecting various sensitivities, guide characteristics, and aging parameters. The correction factors may be stored in a memory located in the microcontroller 739. The correction factors may be entered by the remote control. For example, a Service Department, a distributor, and/or a customer may change the correction factors as required. Besides the possible correction of microphone properties resulting from aging or replacement of the microphone capsule, an on-site customized tuning of microphones may be possible.

Figure 8:
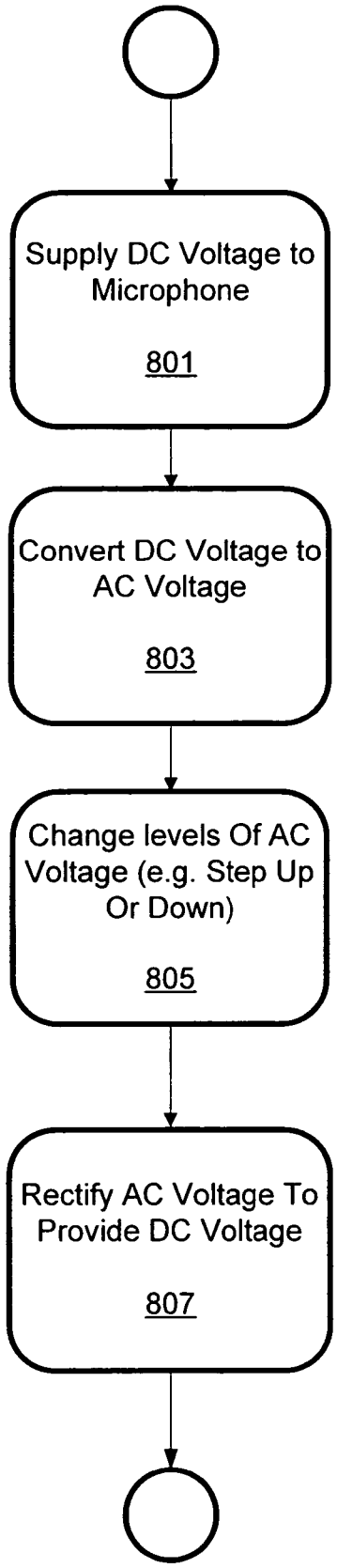
FIG. 8 is a flow diagram for adjusting the polarization voltage.

A flow diagram for supplying power to a microphone system is shown in FIG. 8. A DC voltage may be supplied to the microphone system (act 801). The voltage may be supplied from a phantom power supply. Additional power source also may be provided. The DC voltage may be provided to a power supply such as the power supply 111 and 410 in FIGS. 1 and 4. To change levels, the DC voltage may be converted to an AC voltage through an analog digital converter (act 803). The analog digital converter may be a control unit such as the control unit 112. The AC frequency may be about 100 kHz to about 130 kHz. The AC voltage may be supplied to a transformer such as the transformer 14 of FIG. 1 that may have multiple secondary coils, where each coil provides a secondary voltage (act 805) specific to the supplied circuit.

The secondary voltage may be rectified to provide a DC voltage (act 807). A polarization voltage, a supply voltage for an audio amplifier, and an operational voltage for another electronic circuit or device may be supplied (act 807). The polarization voltage may be applied to a microphone capsule. The supply voltage may be stepped up to a value greater than the DC voltage supplied from the phantom power supply. The operational voltage may be provided to the electronic circuit or device such as control electronics, LED displays, A/D converter, etc.

Figure 9:
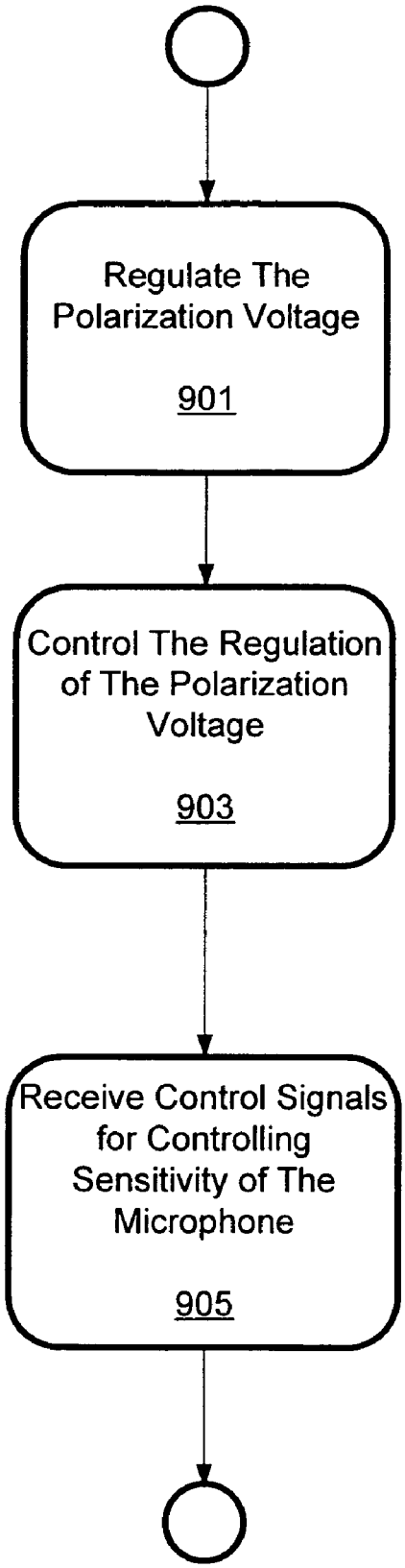
FIG. 9 is a flow diagram for regulating a polarization voltage.

A flow diagram for a method of regulating a polarization voltage is shown in FIG. 9. The polarization voltage may be regulated (act 901) to provide a consistent output by adjusting the polarization voltage to a microphone capsule such as the microphone capsule 109 of FIGS. 1 and 4. The regulation of the polarization voltage may be controlled (act 903) by a microcontroller 739 and a regulation circuit 770 such as the digital regulation circuits 47, 670 and 770 and the analog regulation circuits 48, 680 and 780 of FIGS. 1, 6 and 7. The microcontroller 739 of the digital regulation circuit 770 may have a reference voltage and/or correction factors to set the polarization voltage.

Control signals may be transmitted (act 905) from a remote location such as a mixing table or mixing board to control the sensitivity of the microphone capsule 109. At act 905, the signals may be sent under the guidance of a technician as an actor traverses a sound stage and the system adjusts the microphone capsule sensitivity to pick up the actor's voice. The correction factors may be provided to the microcontroller as part of calibrating the microphone. As the diaphragm ages, the correction factors may be used to offset any instabilities or degradations that occur.

Figure 10:
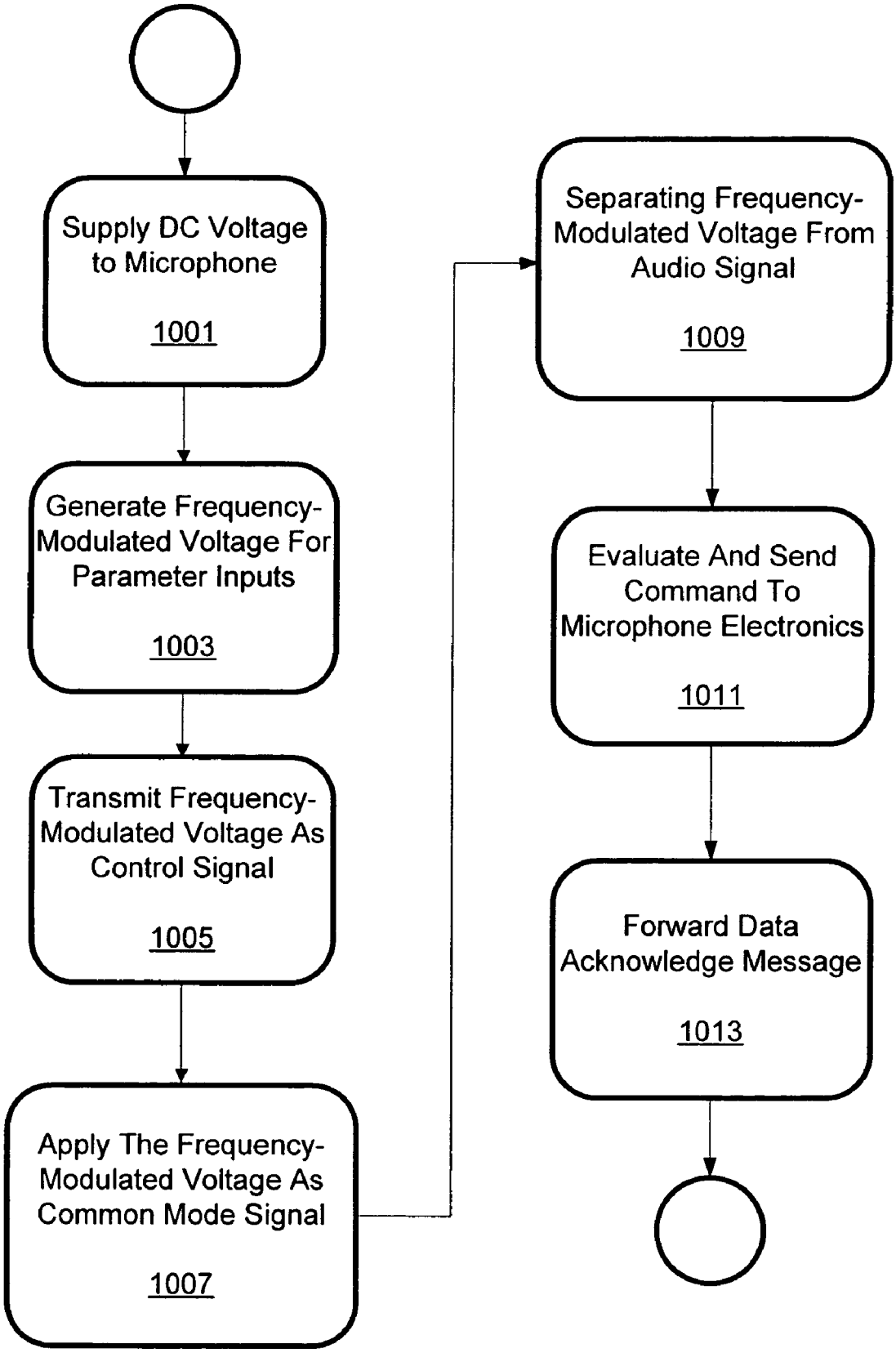
FIG. 10 is a flow diagram for a method of remotely controlling a microphone.

A flow diagram of a method for remotely controlling a microphone system is shown in FIG. 10. A DC voltage may be supplied to a microphone system from a phantom power supply (act 1001). A frequency-modulated voltage signal, which includes control signals to control microphone parameters, may be generated (act 1003). The frequency-modulated signal may be transmitted through cable conductors that conduct the DC power from the phantom power supply (act 1005). The frequency-modulated signal may be transmitted to the microphone system and suppressed toward the mixer (act 1007). A differential input amplifier may suppress the modulated signal as a common mode signal (act 1007). In the microphone system, the frequency-modulated voltage may be separated from the audio signals (act 1009). A microcontroller in the microphone system may evaluate control information contained in the control signal and send the control information to the microphone electronics (act 1011). The microphone electronics may transmit a data acknowledge message (act 1013) to the remote control unit. The acknowledgement (act 1013) is not a necessary element and may be omitted.

The power supply in the microphone system may provide optimal voltages to the microphone capsule, the audio amplifier and to other microphone electronics. In particular, the power supply may generate and provide a stable and controlled polarization voltage. The polarization voltage may be regulated based on the correction factors, which in turn improves the sensitivity of the microphone system. Other parameters of the microphone system may be adjusted so that the entire sensitivity of the microphone system improves. The regulation of the microphone parameters includes remote control.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A capacitor microphone comprising:

a microphone capsule; and a circuit that regulates a polarization voltage to the microphone capsule, further comprising:

an analog regulation circuit supplied with an unregulated voltage, the analog regulation circuit applies the polarization voltage to the microphone capsule; and a digital regulation circuit connected to the analog regulation circuit, the digital regulation circuit including a controller that controls the analog regulation circuit, sets the value for the polarization voltage, and samples the output of the analog regulation circuit.

2. The capacitor microphone of claim 1, where the circuit for the regulation of the polarization voltage has a reference voltage source.

3. The capacitor microphone of claim 2, where the reference voltage source is used to set the value of the polarization voltage.

4. The capacitor microphone of claim 3, where the reference voltage is used to provide a signal to the analog regulation circuit to set the value of the polarization voltage.

5. The capacitor microphone of claim 1, where the controller is a microcontroller.

6. The capacitor microphone of claim 1, where the controller is a complex programmable logic device.

7. The capacitor microphone of claim 1, where the controller further comprises a memory.

8. The capacitor microphone of claim 1, where the memory stores a correction factor.

9. The capacitor microphone of claim 1, where the polarization voltage is set using a correction factor.

10. The microphone claim 1, further comprising: a phantom power unit; and a cable conductor in an audio cable connected to the phantom power unit, where the phantom power unit supplies power to the capacitor microphone.

11. The capacitor microphone of claim 1, further comprising a battery that supplies power to the capacitor microphone.

12. The capacitor microphone of claim 1, where the microphone capsule includes a diaphragm.

13. The capacitor microphone of claim 1, further comprising a DC/DC converter for supplying power to the microphone.

14. The capacitor microphone of claim 13, where the DC/DC converter comprises: a power controller that converts a DC voltage to an AC current; and a transformer having a plurality of coils where one coil is a primary coil and another coil is a secondary coil that provides power to a circuit in the microphone.

15. The capacitor microphone of claim 14, where the circuit connected to the secondary coil comprises a rectifier circuit element.

16. The capacitor microphone of claim 14, where the DC/DC converter further comprises a constant-current source.

17. A capacitor microphone comprising:

a microphone capsule; and means for regulating a polarization voltage to the microphone capsule, further comprising:

means for analog voltage regulation that applies the polarization voltage to a microphone capsule; and means for digitally regulating an analog voltage, including means for controlling the means for analog voltage regulation, setting the value for the polarization voltage, and sampling the output of the analog regulation circuit.

18. The capacitor microphone of claim 17, further comprising:

means for converting DC power to AC power; and means for transforming the AC power applied to a primary coil to AC power from a plurality of secondary coils, each coil from the plurality of secondary coils supplies a circuit from a plurality of circuits with the transformed AC power.

19. The capacitor microphone of claim 18, where the means for regulating comprises a reference voltage source.

20. The capacitor microphone of claim 19, where the reference voltage source sets a value of the polarization voltage.

21. The capacitor microphone of claim 19, where the reference voltage source provides a signal to the means for analog voltage regulation to set the value of the polarization voltage.

22. The capacitor microphone of claim 21, where the means for controlling stores a correction factor.

23. A microphone comprising:

a microphone capsule;

a DC/DC converter for supplying power to the microphone where the DC/DC converter includes a power controller that converts a DC voltage to an AC voltage and a transformer having a primary coil and a plurality of secondary coils, each secondary coil supplying a circuit with a voltage that is isolated from a circuit connected to another secondary coil;

an analog regulation circuit supplied with a voltage from the DC/DC converter, the analog regulation circuit applies the polarization voltage to the microphone capsule; and a digital regulation circuit connected to the analog regulation circuit, the digital regulation circuit including a controller that controls the polarization voltage from the analog regulation circuit, sets the value for the polarization voltage, and samples the output of the analog regulation circuit.

24. The microphone of claim 23, where the digital regulation circuit has a reference voltage from which the digital regulation circuit sets a value for the polarization voltage.

25. The microphone of claim 23, further comprising: a phantom power unit; and a cable conductor in an audio cable connected to the phantom power unit, where the phantom power unit supplies power to the capacitor microphone.

26. The capacitor microphone of claim 23, further comprising a battery coupled to the capacitor microphone.

27. A method for controlling a polarization voltage comprising:

supplying a DC voltage to a microphone; converting the DC voltage to a first AC Voltage;

transforming the first AC voltage to a second AC voltage in a first circuit isolated from a third AC voltage;

rectifying the second AC voltage into a DC voltage that is the polarization voltage in a microphone capsule;

regulating the polarization voltage with an analog regulation circuit; and controlling the analog regulation circuit with a digital regulation circuit, where the digital regulation circuit has a controller that sends a signal to the analog regulation circuit setting a value for the polarization voltage.

* * * * *

UNITED STATES PATENT AND TRADEMARK OFFICE

CERTIFICATE OF CORRECTION

PATENT NO. : 7,620,189 B2
APPLICATION NO. : 11/094805
DATED : November 17, 2009
INVENTOR(S) : Lang et al.

It is certified that error appears in the above-identified patent and that said Letters Patent is hereby corrected as shown below:

At column 1, line 12, "825and..." should be changed to "825 and..."

At column 3, line 55, "50 providing about..." should be changed to "150 providing about..."

At column 4, line 11, "...the microphone 100" should be changed to "the microphone system 100"

At column 4, line 35, "of the frequency ..." should be changed to "the frequency..."

At column 5, line 13, "phone coil 109" should be changed to "phone capsule 109"

At column 6, line 57, "...the Zener diode 427" should be changed to "...the Zener diode 470"

At column 7, line 4, "...may lose some of power..." should be changed to "...may lose some power..."

At column 7, line 19, "amplifier 10..." should be changed to "amplifier 110..."

At column 7, line 22, "The Zener diode..." should be changed to "The Zener diode 470..."

At column 7, line 40, "...the microphone capsule 9" should be changed to "...the microphone capsule 109"

At column 8, line 62, "The microphone 540..." should be changed to "The microphone system 540..."

At column 9, line 16, "...audio lines 1 and 2..." should be changed to "...audio lines 511 and 512..."

At column 9, line 40, "microphone 600. The capacitor microphone 600..." should be changed to "microphone system 600. The capacitor microphone system 600..."

At column 10, line 60, "...an A/C converter..." should be changed to "...an A/D converter..."

At column 11, line 23, "...the transformer 14..." should be changed to "...the transformer 114..."

Signed and Sealed this

Fourteenth Day of December, 2010

David J. Kappos

David J. Kappos
*Director of the United States Patent and Trademark Office*

At column 11, line 43, “digital regulation circuits 47, 670 and 770...” should be changed to “digital regulation circuits 147, 647 and 770...”

At column 11, line 44, “regulation circuits 48, 680 and 780...” should be changed to “regulation circuits 148, 648 and 780...”

At column 11, line 59, “...in FIG. 10.A DC...” should be changed to “...in FIG. 10. A DC...”

At column 14, line 34, claim 27, “...AC Voltage...” should be changed to “...AC voltage...”